United States Patent [19]

Whiteley

[11] 4,062,345

[45] Dec. 13, 1977

[54] AIR HEATING AND CIRCULATING APPARATUS

[76] Inventor: Isaac C. Whiteley, 1650 S. Canyon Drive, Redmond, Oreg. 97756

[21] Appl. No.: 620,938

[22] Filed: Oct. 9, 1975

[51] Int. Cl.[2] ..... F24B 7/00; F24B 9/00

[52] U.S. Cl. ..... 126/121; 126/132; 237/51

[58] Field of Search ..... 126/121, 131, 143, 132; 237/51

[56] References Cited

U.S. PATENT DOCUMENTS

| | | | |
|---|---|---|---|
| 1,640,771 | 8/1927 | Nannum | 126/121 |
| 2,161,723 | 6/1939 | Rutland | 126/121 |
| 3,001,521 | 9/1961 | Reilly | 126/121 |
| 3,394,697 | 7/1968 | Lewis | 126/132 |
| 3,896,785 | 7/1975 | Nelson | 126/121 |
| 3,942,509 | 3/1976 | Sasser | 126/121 |

FOREIGN PATENT DOCUMENTS

| | | | |
|---|---|---|---|
| 155,187 | 12/1920 | United Kingdom | 126/131 |

*Primary Examiner*—Irwin C. Cohen

*Attorney, Agent, or Firm*—Robert H. Epstein

[57] ABSTRACT

Air heating and circulating apparatus adapted to be positioned on the floor of a fireplace to produce heat pumping action without requiring a blower includes a base pipe defining a primary heating chamber and an inlet leg for supplying air thereto, a hot air discharge pipe defining a secondary heating chamber disposed above the primary heating chamber and an outlet leg for discharging heated air into a room, and a plurality of support pipes mounting the hot air discharge pipe above the base pipe and establishing communication between the primary and secondary heating chambers. The hot air discharge pipe is upwardly inclined from the secondary heating chamber to the outlet leg and the support pipes are arranged at an angle to the vertical such that air heated in the primary heating chamber rises in the apparatus to be provided with a horizontal velocity component for discharge through the outlet leg. An electrically operated blower can be used with the apparatus to force air through the inlet leg from the apparatus and increase hot air discharge.

8 Claims, 6 Drawing Figures

AIR HEATING AND CIRCULATING APPARATUS

BACKGROUND OF THE INVENTION

1. Field of the Invention

The present invention pertains to fireplace heating and, more particularly, to air heating and circulating apparatus for installation within a fireplace to produce heat pumping action without requiring a blower.

2. Discussion of the Prior Art

Fireplaces are used a great deal for heating and for the pleasant ambiance produced thereby; however, fireplaces are not notorious for the wasted heat and fuel associated therewith in that not only does a great amount of heat created by the burning of fuel, such as wood, coal and the like, escape through the fireplace chimney but heat from the remainder of the house or building housing the fireplace is also exhausted through the fireplace chimney.

There have been attempts in the prior art to provide apparatus for increasing the efficiency of fireplace heating by drawing or forcing air through the fireplace to heat the air and return the heated air to the room, as exemplified by U.S. Pat. No. 2,642,859 to Brown. Such prior art apparatus, however, have suffered the disadvantages of being relatively bulky, expensive and difficult to install; and, further, such apparatus have invariably drawn air into the fireplace under a support for the burning fuel and forced the heated air out of the fireplace at a location vertically spaced from the indrawn air near the top of the fireplace. The circulation provided by such apparatus is limited, and the burning coals and ashes have tended to be massed at the rear of the apparatus tending to burn out the apparatus.

U.S. Pat. Nos. 2,828,078 to Snodgrass, 3,001,521 to Reilly and 3,240,206 to Schutt are exemplary of prior art apparatus for supplying heated air from a fireplace by means of conduits forming parts of grates or incorporating baffles and adapted to have air blown therethrough. While these apparatus provide increased circulation of hot air, they are not as efficient in preserving fuel and obtaining maximum heat from fuel as is desirable.

In order to establish a continuous flow of heated air, the prior art has normally used blowers or fans to force air through the fireplace heating apparatus; however, such blowers or fans cannot be used in locations where no electrical power or other suitable energy source is available. Accordingly, attempts have been made to construct fireplace heating apparatus in such a manner as to create a heat pumping action from the rising of heated air. These attempts, as exemplified by U.S. Pat. Nos. 1,313,085 to Greene, 1,608,745 to Holbek, 1,640,771 to Hannum, 2,359,197 to Brooks and 2,642,859 to Brown, have had the disadvantages of having relatively complex structure and relying on circulation throughout a room based essentially on vertical air flow.

SUMMARY OF THE INVENTION

Accordingly, it is a primary object of the present invention to overcome the disadvantages of the prior art by providing air heating and circulating apparatus adapted to be placed in a fireplace to horizontally circulate heated air with a heat pumping action without requiring the use of a blower.

Another object of the present invention is to dispose an upwardly inclined, hot air discharge pipe defining a secondary heating chamber and an outlet leg above a base pipe defining a primary heating chamber and an inlet leg such that the inlet leg supplies room air to the primary heating chamber on one side of the fireplace and the outlet leg discharges hot air to the room on the opposite side of the fireplace to create substantially horizontal circulation of air in the room.

The present invention has a further object in the heating of air in apparatus in a fireplace to create a horizontal velocity component for the heated air as it is discharged without requiring an electrically operated blower.

An additional object of the present invention is to utilize a blower with apparatus using a heat pumping action to circulate heated air in order to produce continuous hot air flow and permit the use of an additional outlet leg for discharging hot air.

Yet another object of the present invention is to utilize a small tube to direct a stream of air at and along a primary heating chamber of fireplace air heating and circulating apparatus to produce even burning of fuel, increase the amount of hot coals and decrease pollution exiting through the fireplace chimney.

The present invention has an additional object in the use of a coiled tubing in the primary heating chamber of fireplace air heating and circulating apparatus in order to permit heating of water passing through the coiled tubing.

Some of the advantages of the present invention of the prior art are that the air heating and circulating apparatus of the present invention discharges hot air at substantially the same level as cool room is drawn into the apparatus, the apparatus produces good circulation without requiring a blower, and the apparatus is relatively simple in construction.

The present invention is generally characterized in an air heating and circulating apparatus adapted to be positioned on the floor of a fireplace including a base pipe defining a primary heating chamber adapted to be positioned at the rear of the fireplace and an inlet leg angularly extending from one end of said primary heating chamber to an inlet opening and adapted to be positioned along one side of the fireplace for supplying air to the primary heating chamber, a hot air discharge pipe defining a secondary heating chamber adapted to be positioned at the rear of the fireplace above the primary heating chamber and an outlet leg angularly extending from one end of the secondary heating chamber to an outlet opening and adapted to be positioned along an opposite side of the fireplace for discharging heated air, the hot air discharge pipe being arranged on an upward incline from the secondary heating chamber to the outlet opening, and support pipes mounting the hot air discharge pipe above the base pipe and providing communication between the primary heating chamber and the secondary heating chamber whereby air is heated in the primary heating chamber and moves to the secondary heating chamber and the heated air in the secondary heating chamber is discharged from the outlet opening due to the incline of the hot air discharge pipe.

Other objects and advantages of the present invention will become more apparent from the following description of the preferred embodiment taken in conjunction with the accompanying drawings.

DESCRIPTION OF THE PREFERRED EMBODIMENTS

Figure 1:
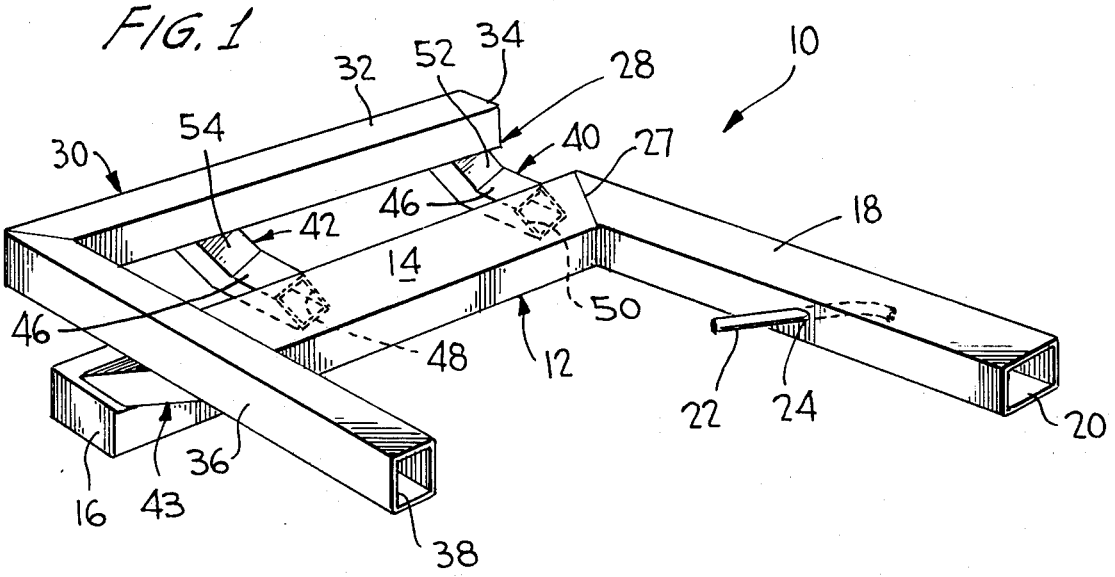
FIG. 1 is a perspective view of air heating and circulating apparatus according to the present invention.
Figure 2:
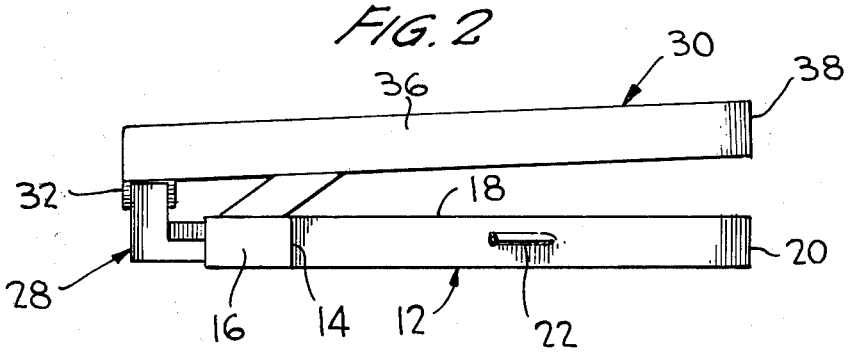
FIG. 2 is a side elevation of the air heating and circulating apparatus of FIG. 1.
Figure 3:
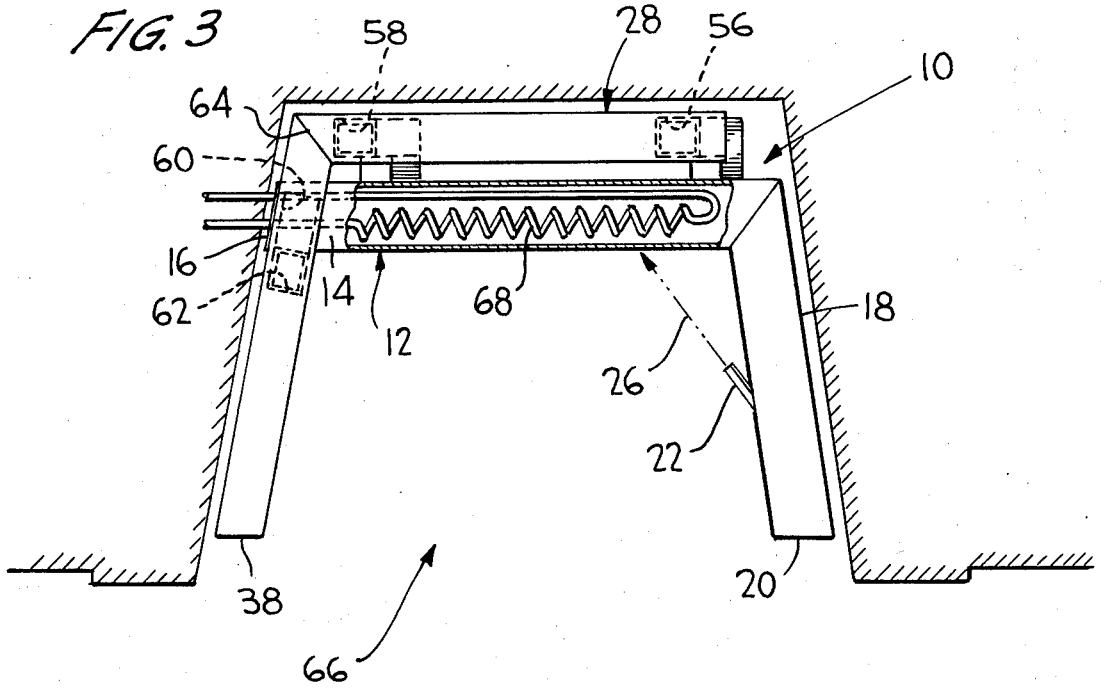
FIG. 3 is a top plan view of the air heating and circulating apparatus of FIG. 1 installed in a fireplace.

Blowerless air heating and circulating apparatus 10 according to the present invention is shown in FIGS. 1, 2 and 3 and includes a generally L-shaped base pipe 12 defining a primary heating chamber 14 having a closed end 16 and an opposite open end communicating with an inlet leg 18 angularly extending from the primary heating chamber at the open end. The inlet leg 18 terminates at an inlet opening 20 adapted to be positioned near the front of a fireplace to supply room air to the primary heating chamber 14. A small diameter tube 22 extends through a hole 24 in the inner side wall of the inlet leg 18 and has an outer portion extending at an angle to the primary heating chamber 14 to direct a jet of air 26 angularly at and along the front side wall of the primary heating chamber and an inner portion extending within the inlet leg 14 to receive air supplied to the heating and circulating apparatus 10 via inlet opening 20. The base pipe can be made of any suitable material capable of withstanding the heat in a fireplace and can be made of ⅛ inch thick, 2 by 3 inches rectangular mild steel and the primary heating chamber 14 can be made of 3/16 inch thick, 2 by 5 inches rectangular mild steel with the primary heating chamber welded at 27 to the inlet leg. The tube 22 is preferably made of ½ inch diameter steel tubing and is welded in the hole 24 in the inlet leg.

The heating and circulating apparatus 10 has a superstructure 28 including a generally L-shaped hot air discharge pipe 30 defining a secondary heating chamber 32 having a closed end 34 and an open end communicating with an outlet leg 36 angularly extending from the secondary heating chamber to an outlet opening 38 for discharging heated air. The hot air discharge pipe 30 is supported above the base pipe 12 by support pipes 40, 42 and 43 such that the secondary heating chamber 36 is disposed above and slightly in back of the primary heating chamber 14. Support pipes 40 and 42 are L-shaped and have horizontal bottom legs 44 and 46 fixed in holes 48 and 50, respectively, in the back side wall of primary heating chamber 14. Legs 52 and 54 extend upwardly from legs 44 and 46 at an angle to the vertical and are fixed in holes 56 and 58, respectively, in the bottom wall of secondary heating chamber 32. Support pipe 43 has an end fixed in a hole 60 in the top wall of primary heating chamber 14 near closed end 16 and extends upwardly at an angle to the vertical to an opposite end fixed in a hole 62 in the outlet leg 36. The superstructure 28 can be formed of any suitable material capable of withstanding the heat in a fireplace. Preferably, the hot air discharge pipe is made of two pieces of ⅛ inch thick, 2 by 2 inches rectangular mild steel welded at 64 to form the secondary heating chamber 32 and outlet leg 36, and the support pipes 40 and 42 are made of two pieces of 3/16 inch thick, 2 by 2 inches rectangular mild steel welded at the corner to form the L-shaped configuration and welded at the ends in holes 48 and 50 to the primary heating chamber 14 and in holes 56 and 58 to the secondary heating chamber 32. The support pipe 53 is preferably made of 3/16 inch thick, 2 by 2 inches rectangular mild steel welded in the holes 60 and 62 to the primary heating chamber 14 and the outlet leg 36, respectively.

In operation, the air heating and circulating apparatus 10 is placed in a fireplace such as 66, as shown in FIG. 3, with the inlet opening 20 and the outlet opening 38 being disposed at the front of the fireplace and the primary heating chamber 14 being positioned at the rear of the fireplace spaced from the back firewall. Fuel, such as wood, coal or the like, is piled on the primary heating chamber 14 such that once a fire has been started, air in the primary heating chamber will be heated and the heated air will rise passing through support pipes 40 and 42 to secondary heating chamber 32 and through support pipe 43 to outlet leg 36. The inclination of the support pipes 40, 42 and 43 cause the ascending heated air to have a horizontal velocity component directed out of the fireplace through the outlet opening 38 and the upward incline of the hot air discharge pipe from the secondary heating chamber to the outlet opening also produces a horizontal velocity component for the heated air such that hot air will be discharged from the outlet leg 36 with a natural heat pump action without requiring a blower for the air heating and circulating apparatus 10. As air is heated in the primary heating chamber 14 amd rises through the superstructure 28 to be discharged, cool floor level room air will be drawn into the primary heating chamber through inlet opening 20 and inlet leg 18. As the floor level, cool air is drawn through the inlet leg, a portion of the air will be directed toward the front side wall of the primary heating chamber via tube 22 to form jet 26, and the air jet or stream 26 produces even burning of fuel, increases the amount of hot coals and decreases pollution exiting through the fireplace chimney. Since the inlet leg 18 and the outlet leg 36 are disposed along opposite side walls of the fireplace and at substantially the same level, horizontal air circulation will be created in the room.

The air heating and circulating apparatus 10 is particularly useful in areas where no electrical energy is available to operate a fan or blower to force air through the apparatus; and, in such situations, the apparatus may be modified to heat water by disposing a coiled metal tube 68 in the primary heating chamber, as shown in FIG. 3. The ends of the water heating tube 68 extend through the closed end 16 of the primary heating chamber such that water moved through the coils will be heated. The blowerless apparatus is also particularly useful with fireplaces having glass doors in that the inlet opening 20 can be disposed adjacent the vent openings at the bottom of the glass door structure; and, when heat is desired in a room, the glass doors can be opened permitting the heated air discharged from outlet opening 38 to enter the room.

Figure 4:
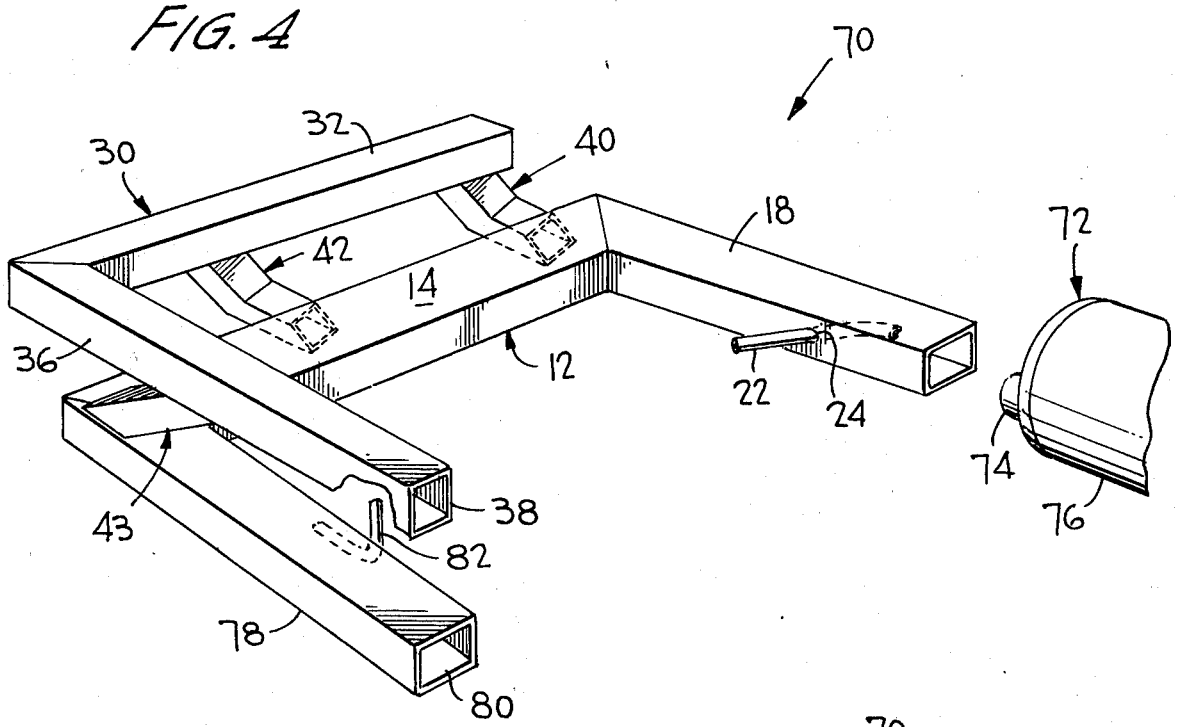
FIG. 4 is a perspective view of another embodiment of air heating and circulating apparatus according to the present invention.
Figure 5:
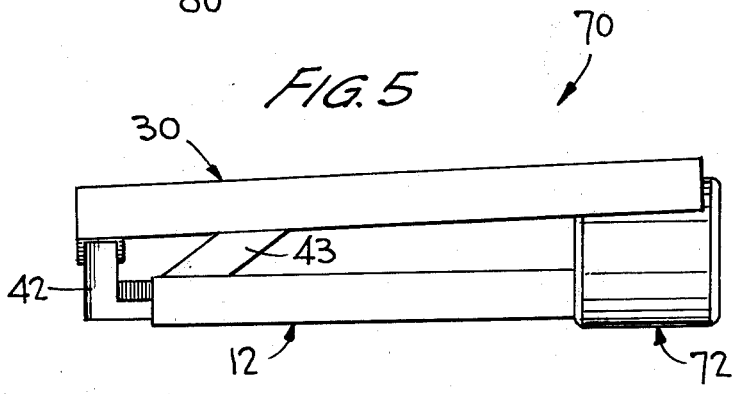
FIG. 5 is a side elevation of air heating and circulating apparatus of FIG. 4.
Figure 6:
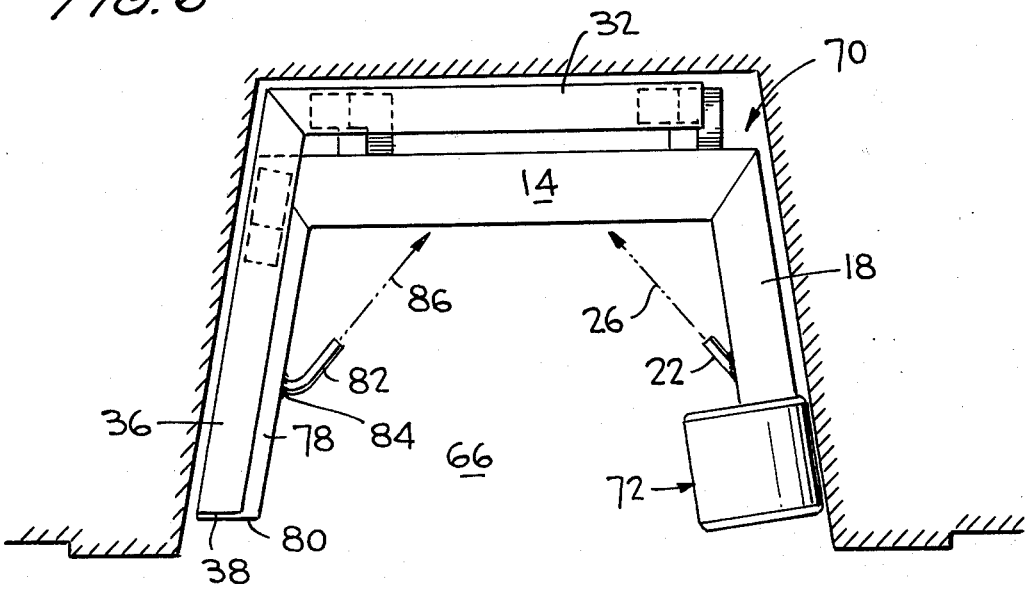
FIG. 6 is a top plan view of the air heating and circulating apparatus of FIG. 4 installed in a fireplace.

Another embodiment of air heating and circulating apparatus 70 according to the present invention is shown in FIGS. 4, 5 and 6, this apparatus differing from the air heating and circulating apparatus 10 of FIGS. 1, 2 and 3 primarily due to the use of a blower to force air through the apparatus and an additional outlet leg to discharge heated air. Parts of the air heating and circulating apparatus of FIGS. 1, 2 and 3 are given identical reference numbers and are not described again for the sake of brevity.

The inlet leg 18 of the base pipe 12 is shortened to accommodate a blower unit 72 such that when the apparatus 70 is placed in a fireplace, as shown in FIG. 6, the blower unit 72 will be disposed at the front of the fireplace. The blower unit 72 includes a squirrel cage or centrifugal fan of the type having an electric motor for rotating an impeller having an axial opening for receiving air and carrying blades for tangentially expelling the air via an outlet 74 adapted to be received in the inlet opening 20 of the base pipe 12 to force air into the inlet leg 18. The blower is mounted in an insulated housing 76 to reduce noise and maintain the blower in a cool environment. While any blower structure can be utilized with the embodiment of FIGS. 4, 5 and 6 with the blower disposed internally or externally of the fireplace, the unit as described above is preferred since the entire apparatus can be disposed within the fireplace. Reference is made to copending application Ser. No. 567,851 filed Apr. 14, 1975 entitled "FORCED AIR CIRCULATING HEATING UNIT," the disclosure of which is incorporated herein by reference, for a more specific description of blower unit 72. The primary heating chamber 14 is open at both ends such that a base outlet leg 78 communicates therewith and extends angularly from the primary heating chamber to an outlet opening 80 for discharging heated air. A small tube 82 is fixed in a hole 84 in the inner side wall of base outlet leg 78 to direct a jet of air 86 at the front side wall of primary heating chamber 14. The base outlet leg 78 is preferably constructed in the same manner as inlet leg 18 and is welded to the primary heating chamber 14.

The air heating and circulating apparatus 70 provides natural heat pumping action in the same manner as described above with respect to air heating and circulating apparatus 10 due to the inclination of the hot air discharge pipe 30 and the support pipes 40, 42 and 43. However, additionally, air is forced through the apparatus by the blower unit 72 to provide a more continuous and even flow of heated air exiting from both upper outlet opening 38 of the hot air discharge pipe and lower outlet opening 80 of the base outlet leg 78. Additionally, the jets of air 26 and 86 produced by tubes 22 and 84, respectively, are enhanced by the use of the blower to provide more air to the coals which will amass along the primary heating chamber 14, the jets cooperating with the primary heating chamber to force the air along the front thereof and on the coals. The operation of the generally U-shaped base pipe 12 with the jet tubes 22 and 82 and the blower unit 72 is more specifically described in the above-mentioned patent application Ser. No. 567,851.

In both embodiments of air heating and circulating apparatus 10 and 70 according to the present invention, a great amount of heat is transferred to the air flowing through the apparatus due to the coals laying on the primary heating chamber 14 and being amassed along the front side wall thereof, and additional heat transfer is obtained via the support pipes 40 and 42 which will contact some coals. Furthermore, the secondary heating chamber 30 will be heated by any coals and burning fuel supported thereon as well as by radiation from flames of the fire such that the apparatus is extremely efficient in withdrawing maximum heat from a fire.

The upward slope of the hot air discharge pipe 30 is required to be only on the order of 1:6 such that the outlet opening 38 is spaced only seven to eight inches above the inlet opening 20 thereby assuring good horizontal air flow characteristics since the inlet and outlet openings are at substantially the same level and are disposed on opposite sides of the fireplace. The support pipes 40, 42, and 43 have a height to position the hot air discharge pipe at the required slope or inclination and the angle of the support pipes need only be approximately 45° to produce a sufficient horizontal velocity component for heated air passing from the primary heating chamber 14 to the hot air discharge pipe 30.

Inasmuch as the present invention is subject to many variations, modifications and changes in detail, it is intended that all subject matter discussed above or shown in the accompanying drawings be interpreted as illustrative and not in a limiting sense.

What is claimed is:

1. Air heating and circulating apparatus adapted to be positioned on the floor of a fireplace comprising a base pipe defining a primary heating chamber adapted to be positioned at the rear of the fireplace and an inlet leg angularly extending from one end of said primary heating chamber to an inlet opening adjacent the front of the fireplace and adapted to be positioned along one side of the fireplace for supplying air to said primary heating chamber;

a hot air discharge pipe defining a secondary heating chamber positioned above and slightly behind said primary heating chamber and having an open end and a closed end and an outlet leg angularly extending from said open end of said secondary heating chamber to an outlet opening and adapted to be positioned along an opposite side of the fireplace for discharging air, said hot air discharge pipe being arranged on an upward incline from said secondary heating chamber to said outlet opening; and support pipe means mounting said hot air discharge pipe above said base pipe and providing communication between said primary heating chamber and said secondary heating chamber, said support pipe means including first and second L-shaped support pipes fixed to a rear side wall of said primary heating chamber and a bottom wall of said secondary heating chamber, said first and second support pipes being arranged at an angle to the vertical, whereby air is heated in said primary heating chamber and moves to said secondary heating chamber with a horizontal velocity component and the heated air in said secondary heating chamber is discharged from said outlet opening due to said incline of said hot air discharge pipe.

2. A heating and circulating apparatus as recited in claim 1 wherein an open ended tube extends from said inlet leg toward said primary heating chamber to direct a jet of air toward said primary heating chamber.

3. Air heating and circulating apparatus as recited in claim 1 and further comprising a coiled tube disposed in said primary heating chamber for receiving water to be heated.

4. Air heating and circulating apparatus as recited in claim 1 wherein said base pipe is generally L-shaped and said hot air discharge pipe is generally L-shaped.

5. Air heating and circulating apparatus as recited in claim 1 wherein said support pipe means includes a third support pipe fixed to an end of said primary heating chamber opposite said one end and to said outlet leg and arranged at an angle to the vertical.

6. Air heating and circulating apparatus as recited in claim 5 wherein said base pipe includes a base outlet leg communicating with and angularly extending from said opposite end of said primary heating chamber such that said base pipe is generally U-shaped.

7. Air heating and circulating apparatus as recited in claim 6 wherein said base outlet leg is disposed directly under said outlet leg of said hot air discharge pipe and further comprising blower means at said inlet opening for forcing air through said apparatus.

8. Air heating and circulating apparatus as recited in claim 7 and further comprising tubing means extending from said inlet leg and from said base outlet leg to direct jets of air at and along said primary heating chamber from opposite sides.

* * * * *